US005813545A

United States Patent [19]

Greenberg

[11] Patent Number: 5,813,545

[45] Date of Patent: Sep. 29, 1998

[54] APPARATUS AND METHOD FOR DISPLAY OF STUFFED ANIMALS

[76] Inventor: Robert Greenberg, 4917 Fairway Ridge Cir., West Bloomfield, Mich. 48323

[21] Appl. No.: 815,208

[22] Filed: Mar. 12, 1997

[51] Int. Cl.[6] ..... A47F 7/00

[52] U.S. Cl. ..... 211/13.1

[58] Field of Search ..... 211/13.1, 189, 211/14, 71.01, 72, 85.2

[56] References Cited

U.S. PATENT DOCUMENTS

| | | | |
|---|---|---|---|
| D. 142,018 | 8/1945 | Campbell | 211/13.1 X |
| 877,145 | 1/1908 | Waddell | 211/13.1 X |
| 981,485 | 1/1911 | Seldin | 211/13.1 |
| 4,084,700 | 4/1978 | Dunchock | 211/41.1 |
| 5,228,582 | 7/1993 | Marshall | 211/13.1 X |

*Primary Examiner*—Alvin C. Chin-Shue
*Assistant Examiner*—Sarah Purol
*Attorney, Agent, or Firm*—Rader, Fishman & Grauer PLLC

[57] ABSTRACT

A stuffed animal display apparatus is provided having first and second sections which are provided with holes for supporting and displaying stuffed animals therein.

19 Claims, 2 Drawing Sheets

APPARATUS AND METHOD FOR DISPLAY OF STUFFED ANIMALS

BACKGROUND OF THE INVENTION

Field of the Invention

The present invention relates to a stuffed animal display apparatus, and more particularly, to a stuffed animal display apparatus having a tree-like appearance.

BACKGROUND AND SUMMARY OF THE INVENTION

Stuffed animals are popular collection items throughout the world. Collections of stuffed animals, however, have the potential to occupy a relatively substantial amount of floor space. Thus, stuffed animals are commonly displayed on shelves or stored in a child's toy box. It has also been known to hang stuffed animals on a Christmas tree. However, there still exists a need in the art for an aesthetically pleasing and space saving display for stuffed animals.

Accordingly, it is an object of the present invention to provide a stuffed animal display apparatus which provides an aesthetically pleasing and space saving display for the stuffed animals.

It is still another object of the present invention to provide a stuffed animal display apparatus which is simple in structure, inexpensive to manufacture, durable in use, and easy to mass produce.

These and other objects of the present invention are obtained by providing a stuffed animal display apparatus including a first sheet member having a plurality of holes therethrough and a base portion. A second sheet member having a plurality of holes therethrough and a base portion is attached to the first sheet member such that the first and second sheet members support one another. According to a preferred embodiment of the present invention, the first and second sheet members are in the shape of a profile of a tree. The holes in the first and second sheet members have a dimension sufficient for receiving a stuffed animal therein for supporting and displaying the stuffed animal.

Because the stuffed animal display apparatus resembles a tree, the display apparatus is aesthetically pleasing either empty or with the stuffed animals inserted in the holes therein such that it appears that the stuffed animals are sitting in the tree. The display apparatus of the present invention is especially suitable for children who collect numerous stuffed animals. The display apparatus is easy to reach and helps to keep the stuffed animals off the floor. The diameter of the holes in the display apparatus can be varied depending upon the size of the stuffed animals desired to be stored and displayed on the display apparatus. The apparatus of the present invention is particularly suitable for use with stuffed animals which have stuffing which is displaceable so that the diameter of the stuffed animals can be adjusted to fit within the holes.

Further areas of applicability of the present invention will become apparent from the detailed description provided hereinafter. It should be understood however that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
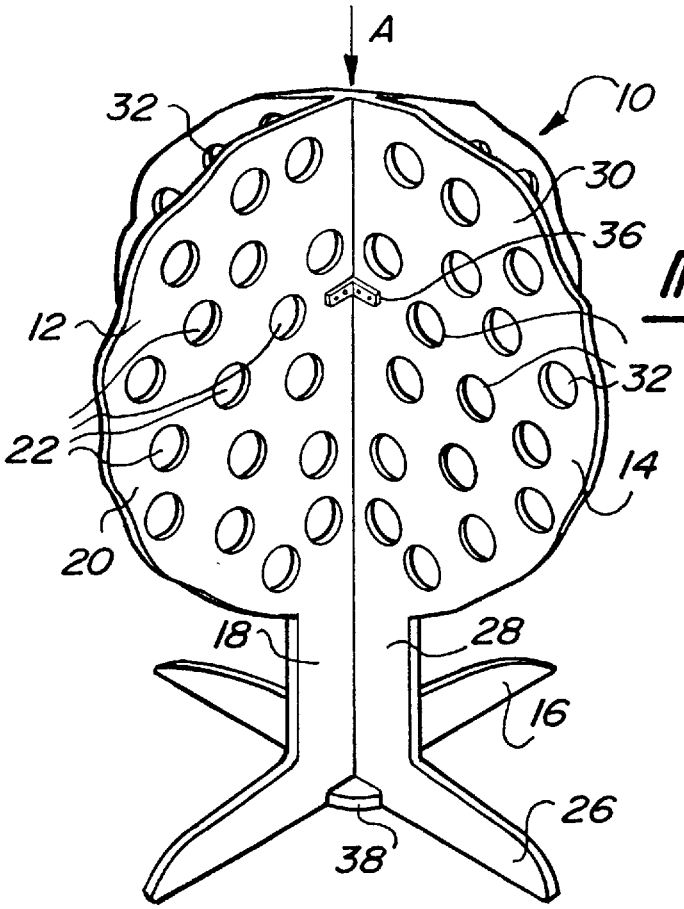
FIG. 1 is a perspective view of a stuffed animal display apparatus having the configuration of a tree according to the principles of the present invention.

With reference to FIGS. 1–5, one preferred embodiment of the stuffed animal display apparatus 10 will be described. The stuffed animal display apparatus 10 includes a first section 12 and a second section 14 which are attached to one another to support one another in a generally vertical position as shown in FIG. 1. The first section 12 of the stuffed animal display apparatus 10 is formed from a sheet member having a shape of a profile of a tree including a base portion 16, a trunk portion 18 extending upwardly from said base portion 16, and an arborous portion 20 extending upward from the trunk portion 18. By "arborous portion", it is meant the foliage or green leafy portion of a tree. The arborous portion 20 of the first section 12 includes a plurality of holes 22 therethrough. The first section 12 includes an elongated slot 24 extending from the base portion 16 to an intermediate position.

The second section 14 of the stuffed animal display apparatus 10 also includes a base portion 26, a trunk portion 28 extending upward from the base portion 26, and an arborous portion 30 extending from the trunk portion 28. The arborous portion 30 of the second section 14 includes a plurality of holes 32 therethrough. A slot 34 is provided in the second section 14 extending from a top edge of the arborous section 30 to an intermediate position.

The first and second sections 12, 14 of the stuffed animal display apparatus 10 are attached to one another by aligning the slots 24, 34, respectively, and sliding the first section 12 downward, as shown by arrow A in FIG. 1, relative to the second section 14. Accordingly, the first and second sections 12, 14 of the stuffed animal display apparatus 10 intersect one another in a perpendicular fashion to provide a self supporting display apparatus. The display apparatus 10 is stood on its base portions 16, 26. The stuffed animal display apparatus 10 can be reinforced by providing L-shaped brackets 36 at the intersection between the first and section sections 12, 14 of the display apparatus 10. The L-shaped brackets can be nailed, screwed, glued, stapled, or fastened by other means in order to stabilize the display apparatus 10.

Figure 2:
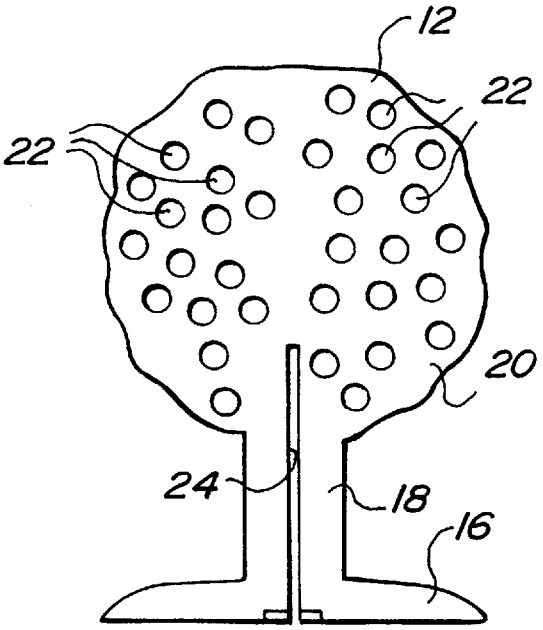
FIG. 2 is a plan view of a first section of the tree-shaped stuffed animal display apparatus.
Figure 3:
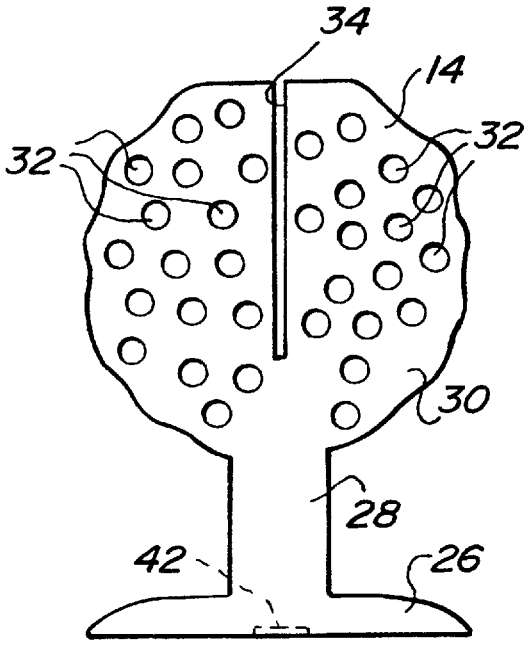
FIG. 3 is a plan view of a second section of the tree-shaped stuffed animal display apparatus.

Furthermore, a reinforcement disk 38 can be provided for reinforcing the base portions 16, 26 of the first and second sections 12, 14. If a reinforcement disk 38 is utilized, a pair of recesses can be provided in the base portions 16, 26 of the first and second sections 12, 14. The recesses 40, 42 are illustrated in dashed lines in the base portions 16, 26 of the first and second sections 12, 14, respectively, as shown in FIGS. 2 and 3. The disk 38 can be glued, nailed, or fastened by other means within the recesses 40, 42, as shown in FIG. 1. It should also be understood that other known reinforcing means can be utilized for reinforcing the stuffed animal display apparatus 10.

The first and second sections 12, 14 of the stuffed animal display apparatus can be cut in the shape of a profile of a tree or other desired shape from a sheet of wood such as plywood or can be formed by injecting or otherwise molding or shaping plastic to form the tree or other profile-shaped sheet members. Other suitable materials (e.g. a suitable cardboard, metal, ceramic or composite material) likewise may be employed. Alternatively, the first and second sections of the display apparatus can be molded integrally with one another. The objects of the present invention can also be obtained by providing a single display section having a base portion and a display portion with a plurality of apertures.

According to a preferred embodiment, the arborous portions 20, 30 of the first and second sections 12, 14 are provided with a coat of green paint representing the foliage of the tree, while the trunk portions and base portions are painted dark brown, gray, or black in order to represent the color of the tree trunk. If the display apparatus is molded from plastic, the apparatus can be molded in color. It should also be noted that various tree profiles may be utilized without departing from the spirit and scope of the present invention. For example, a palm tree or a pine tree profile can be utilized. Furthermore, it is also noted that the present invention can be utilized with profiles of other shapes such as automobiles, trucks, animals, houses or other familiar objects.

Figure 4:
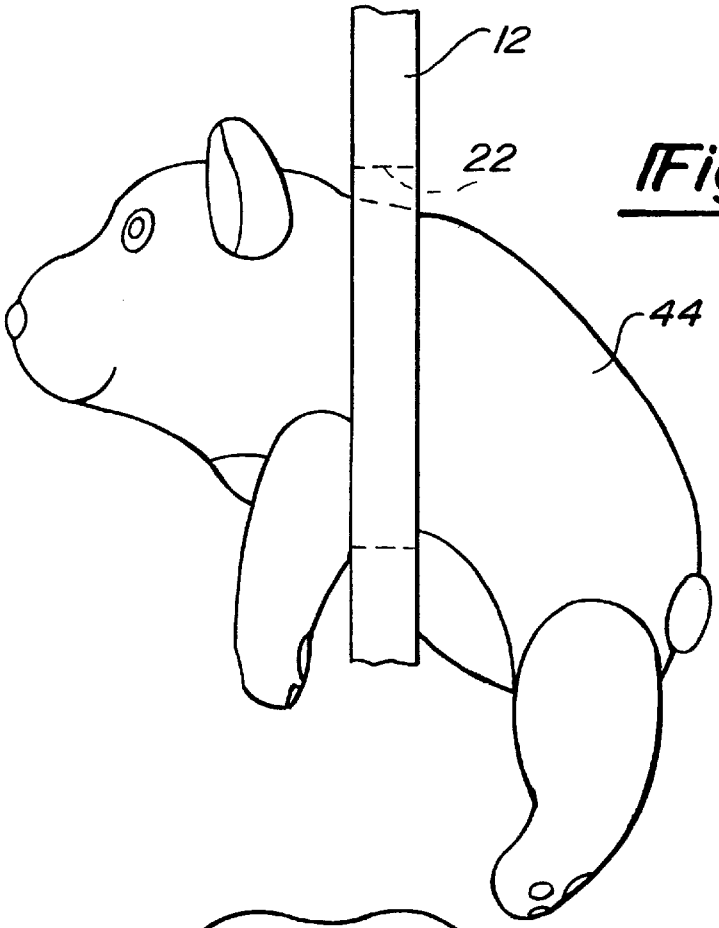
FIG. 4 illustrates a side view of a stuffed animal inserted in one of the holes of the stuffed animal display apparatus.
Figure 5:
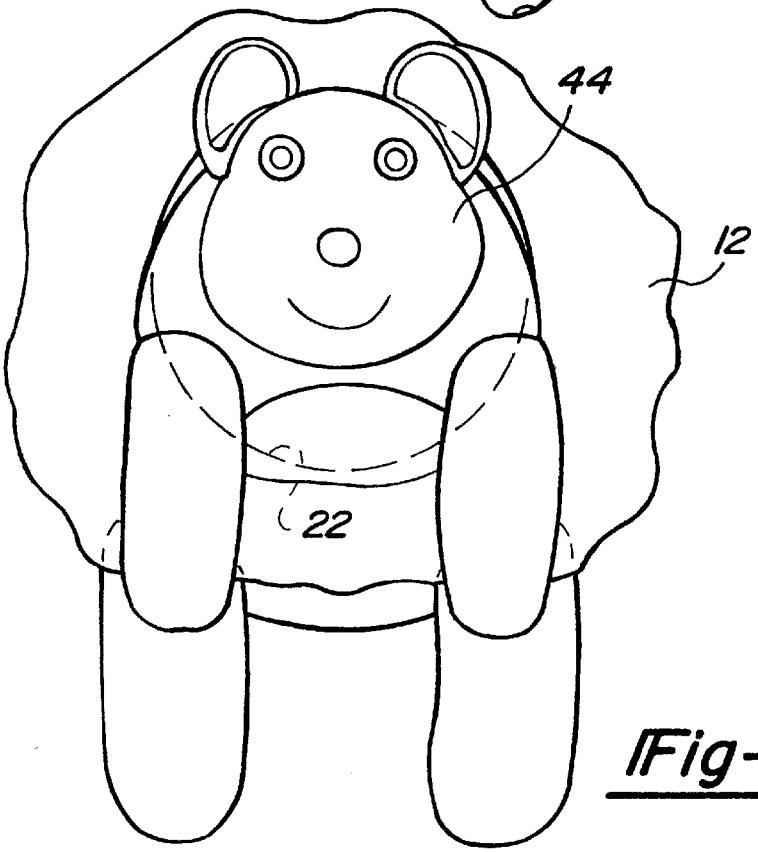
FIG. 5 illustrates a front view of a stuffed animal inserted in one of the holes of the stuffed animal display apparatus according to the principles of the present invention.

The stuffed animal display apparatus 10, according to the present invention, is utilized by inserting a stuffed animal 44 into the holes 22, 32 in each of the first and second sections 12, 14, as shown in FIGS. 4 and 5. According to a preferred embodiment of the present invention, the stuffed animal's head and arms are inserted through the holes 22 and support themselves therein. The holes 22, 32 are provided with a dimension which is sufficient for receiving a stuffed animal therein. As is well known, the size and shape of stuffed animals varies greatly. Accordingly, the display apparatus could be provided with holes of varying shapes or dimensions, or can be provided with holes each having substantially the same diameter. By way of example without limitation, one known stuffed animal having displaceable stuffing, from a Beanie Babies™ collection (TY Inc., Oakbrook, Ill.) may be displayed in the apparatus of the present invention. For that embodiment preferably the aperture is generally circular and approximately 2½ inches in diameter. The thickness of the sections can be thin or can be several inches thick or more. It should also be noted that other collectible items can be displayed with the apparatus of the present invention.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A stuffed animal display apparatus, comprising:

a first sheet member including a plurality of holes therethrough and a base portion; and a second sheet member including a plurality of holes therethrough and a base portion, said first and second sheet members being attached to one another to support one another in a generally vertical position on said base portions;

wherein each of said holes in said first and second sheet members have a predetermined dimension and receive a figurine with displaceable stuffing.

2. The display apparatus according to claim 1, wherein said first and second sheet members have an outer perimeter shaped like a profile of a tree.

3. The display apparatus according to claim 1, wherein said first sheet member is provided with a slot extending vertically from said base portion to an intermediate portion and said second sheet member is provided with a slot extending from a top of said sheet member toward said base portion, wherein said first and second sheet members are attached to one another in a perpendicular fashion by simultaneously inserting said first sheet member in said slot in said second sheet member and inserting said second sheet member in said slot in said first sheet member.

4. The display apparatus according to claim 3, further comprising at least one L-bracket attached to said second sheet member adjacent to said slot in said second sheet member and attached to said first sheet member.

5. The display apparatus according to claim 3, further comprising a reinforcement disk attached to the base portions of said first and second sheet members.

6. The display apparatus according to claim 1, wherein said first and second sheet members are made of wood.

7. The display apparatus according to claim 1, wherein said first and second sheet members are made of plastic.

8. A method of making a stuffed animal display apparatus, comprising the steps of:

providing a first sheet member having a shape of a profile of a tree, said first sheet member including a plurality of holes therethrough and a slot extending from a base portion thereof to an intermediate position;

providing a second sheet member having a shape of a profile of a tree, said second sheet member including a plurality of holes therethrough and a slot extending from a top portion to an intermediate position, and simultaneously inserting said first sheet member into said slot in said second sheet member and inserting said second sheet member into said slot in said first sheet member;

wherein each of said holes in said first and second sheet members have a predetermined dimension and receive a figurine with displaceable stuffing.

9. The method according to claim 8, further comprising the step of attaching an L-bracket to said first and second sheet members.

10. The method according to claim 8, wherein said first and second sheet members are formed from plywood cut in the shape of a profile of a tree.

11. The method according to claim 8, wherein said first and second sheet members are formed from injection molded plastic.

12. The method according to claim 8, further comprising the step of attaching a reinforcement disk to said base portion of said first sheet member and a portion of said second sheet member.

13. A method for displaying collectibles, comprising the steps of:

a. providing a display apparatus having 1. a base portion;

2. a display portion vertically supported by said base portion, said display portion having a plurality of apertures wherein said base portion and said display portion in combination form a shape of a profile of a familiar object; and b. inserting a figurine with displaceable stuffing into one of said apertures and resting said figurine on at least a section of said display portion which defines said aperture c. wherein said display apparatus includes a first sheet member and a second sheet member each having a base portion and a display portion, said first and second sheet members being attached to one another to support one another in a generally vertical position on said base portions.

14. The method according to claim 13, wherein said profile of a familiar object is a profile of a tree.

15. The method according to claim 13, wherein said display apparatus is made from wood.

16. The method according to claim 13, wherein said display apparatus is made from molded plastic.

17. The method according to claim 13, wherein said collectible item is a stuffed animal.

18. The method according to claim 13, wherein said first sheet member is provided with a slot extending vertically from said base portion to an intermediate portion and said second sheet member is provided with a slot extending from a top of said display portion toward said base portion, wherein said first and second sheet members are attached to one another in a perpendicular fashion by simultaneously inserting said first sheet member in said slot in said second sheet member and inserting said second sheet member in said slot in said first sheet member.

19. The method according to claim 18, wherein said display apparatus includes at least one L-bracket attached to said first and second sheet members.

* * * * *